United States Patent [19]

Wien et al.

[11] Patent Number: 4,489,299

[45] Date of Patent: Dec. 18, 1984

[54] SECONDARY CIRCUIT BREAKER FOR DISTRIBUTION TRANSFORMER

[75] Inventors: Raymond E. Wien, Penn Township, West Moreland County, Pa.; Jack G. Hanks, Iowa City, Iowa; John F. Cotton, Athens, Ga.

[73] Assignee: Westinghouse Electric Corp., Pittsburgh, Pa.

[21] Appl. No.: 461,795

[22] Filed: Jan. 28, 1983

[51] Int. Cl.[3] ..... H01H 73/48; H01H 75/00; H01H 77/00

[52] U.S. Cl. ..... 337/70; 335/23; 335/190; 337/38

[58] Field of Search ..... 337/70, 74; 335/23, 335/35, 43, 38, 39, 190, 8, 9, 10; 361/38

[56] References Cited

U.S. PATENT DOCUMENTS

| | | | |
|---|---|---|---|
| 3,287,522 | 11/1966 | Casey | 337/70 |
| 3,382,334 | 5/1968 | Gryctko | 337/38 |
| 3,983,454 | 9/1976 | Cotton et al. | 361/38 |

*Primary Examiner*—Harold Broome
*Attorney, Agent, or Firm*—L. P. Johns

[57] ABSTRACT

A secondary circuit breaker for a distribution transformer characterized by electrical inductive apparatus within an oil-filled housing, and circuit interrupter for controlling current flow through the transformer and comprising a releasable latch arm, trip means operable upon overload conditions to release the latch arm, a latch lever between the trip means and the latch arm and comprising the only operable part therebetween, and the latch lever having a cam surface for latching and unlatching the releasable arm.

6 Claims, 11 Drawing Figures

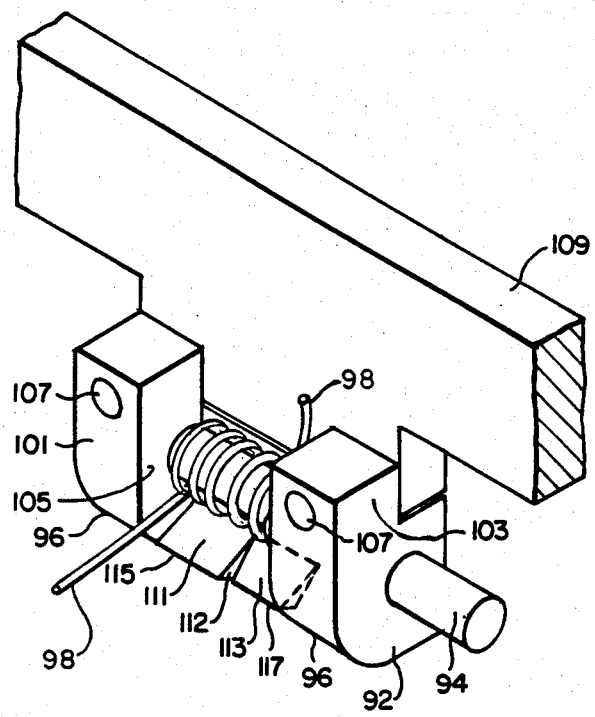
FIG. 9.
FIG. 10.
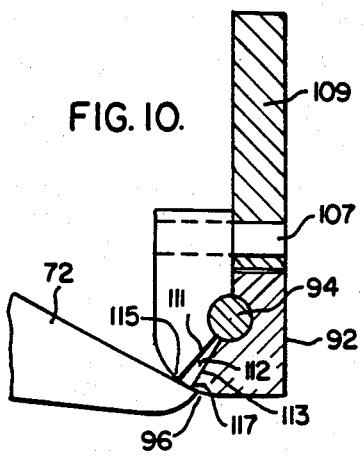
FIG. 11.
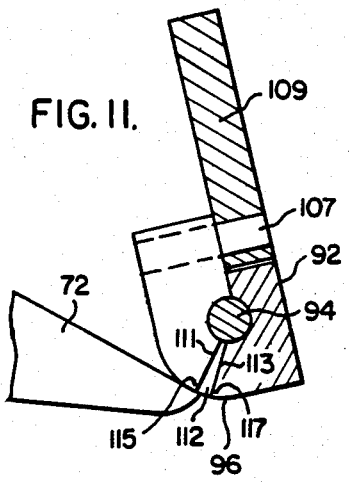

SECONDARY CIRCUIT BREAKER FOR DISTRIBUTION TRANSFORMER

BACKGROUND OF THE INVENTION

1. Field of the Invention

This invention relates to circuit breakers of the type having a bimetallic thermal trip element and, more particularly, to circuit breakers for distribution transformers to control moderate power distribution on feeder circuits.

2. Description of the Prior Art

Power distribution systems include transformers in association with other protective devices for preventing or limiting power overload damage to the transformer. A completely self-protected transformer includes a circuit breaker on the secondary or low voltage side to avoid damage due to overload currents. The secondary circuit breaker disconnects the transformer from its load if the load current exceeds a predetermined rate. Such transformers are disclosed in U.S. Pat. Nos. 3,983,454 and 4,030,053.

For overload current conditions it is desirable that the circuit interruption be completed as rapidly as possible after initiation. For that purpose circuit breakers commonly incorporate a bimetal thermal trip and an instantaneous magnetic trip.

SUMMARY OF THE INVENTION

An oil-filled distribution transformer comprising a transformer housing containing electrical induction apparatus having terminals, a circuit interrupter disposed within the housing and operable between open and closed positions of current flow through the transformer, a handle connected to the circuit breaker for manual operation between said positions, the circuit breaker including a releasable latch arm operable to maintain the breaker in the closed position, trip means for automatically opening the circuit upon overload conditions through the transformer to initiate release of the latch arm, a latch lever movable between latched and unlatched positions of the releasable arm and biased in the latched position and the latch lever being the only part operatively connected between the trip means and the releasable arm, the latch lever having a cam surface for latching and unlatching the releasable arm, the cam surface comprising two release edges for the arm, and means for moving the latch lever laterally of the plane of movement of the arm so as to place one of the release edges in operating position with the arm, whereby the rating of the interrupter is changed.

The advantage of the device of this invention is that a secondary or intermediate latch with associated parts is eliminated thereby reducing the frictional forces required for tripping, getting rid of parts requiring close manufacturing tolerances, and avoiding accidental opening or shock-out due to ambient vibrations. Elimination of the secondary or intermediate latch also results in the reduction of the overall size of the breaker as well as reducing the trip time.

BRIEF DESCRIPTION OF THE DRAWINGS

FIG. 9 is a perspective view of the latch lever;

FIG. 10 is a fragmentary sectional view through one release edge of the cam surface of the latch lever; and FIG. 11 is a fragmentary sectional view through another release edge of the cam surface of the latch lever.

DESCRIPTION OF THE PREFERRED EMBODIMENT

Figure 1:
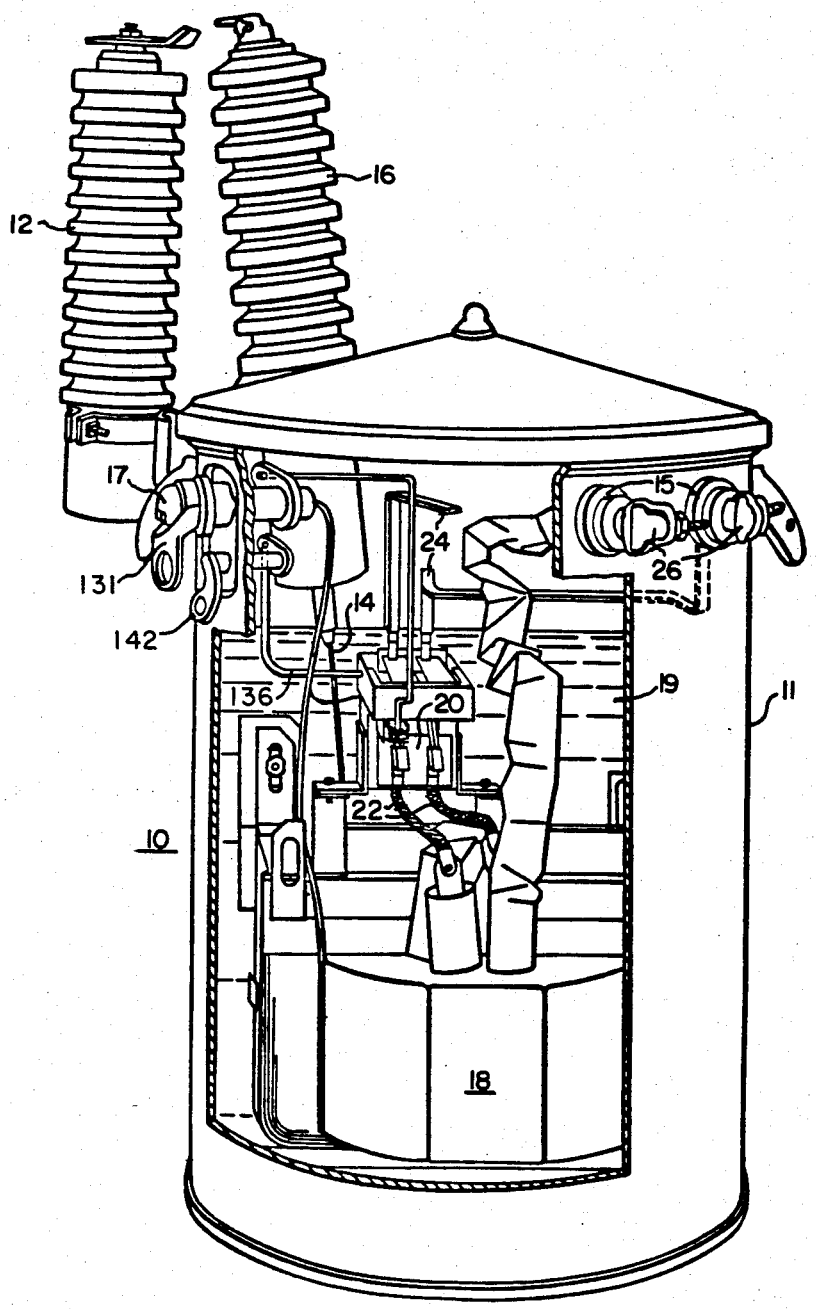
FIG. 1 is a perspective view of an oil-filled distribution transformer.

In FIG. 1 a pole-type completely self-protected distribution transformer is indicated at 10. The transformer 10 includes an enclosure or tank 11 with a lightning arrestor 12 and a primary high voltage bushing 16 mounted thereon. Secondary bushings, such as the low voltage bushing 15, are attached to the enclosure 11 to which the transformer load is connected. A signal light 17 is mounted on the enclosure 11 and is electrically connected to a circuit breaker 20 to be actuated at a predetermined overload. A core-coil assembly 18 is secured inside the enclosure 11 with the circuit breaker 20 attached thereto. Primary winding leads 4 extend from the core-coil assembly 18 to the appropriate high voltage bushings 16. The enclosure 11 is partially filled with an insulating liquid dielectric 19, such as transformer oil. The circuit breaker 20 and the core-coil assembly 18 are immersed in the liquid dielectric 19. Secondary leads 22, coming from the core-coil assembly 18, connect to input terminals on circuit breaker 20. Conductors 24 connect the output terminals of circuit breaker 20 to the low voltage bushings 15 mounted to the transformer tank 11. Appropriate loads are connected to the low voltage terminals 26 of the distribution transformer 10.

Figure 2:
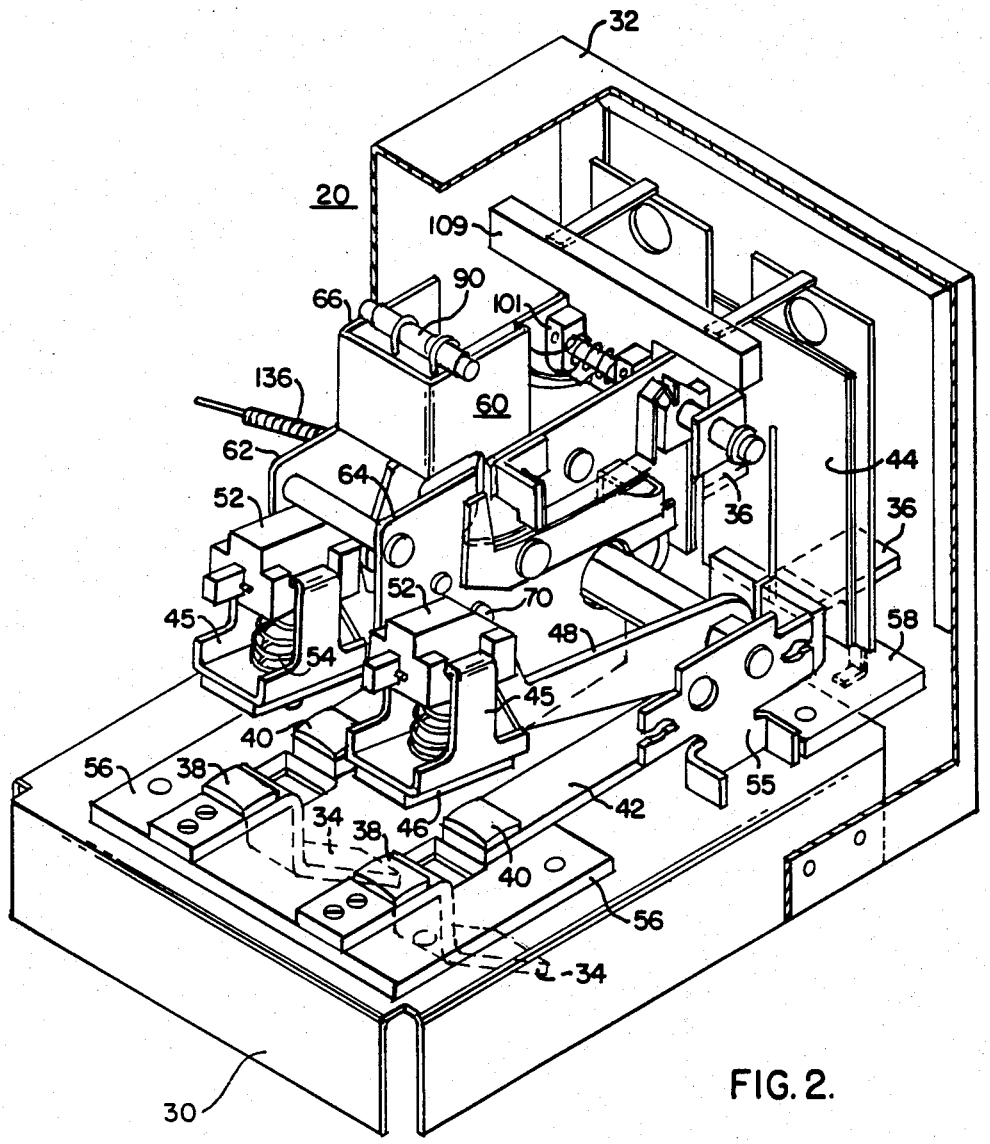
FIG. 2 is a pespective view of a secondary circuit interrupter for use on the distribution transformer.

The circuit breaker 20 (FIG. 2) is mounted on a metallic base 30. A cover 32 is provided partially surrounding the sensing and tripping elements of the circuit breaker 20 to provide protection during handling. Secondary leads 22 (FIG. 1) are attached to incoming circuit breaker terminals 34 (FIG. 2). Electrical conductors 24, disposed between the circuit breaker 20 and the low voltage transformer bushings 15, attach to circuit breaker 20 at terminals 36. Circuit breaker terminals 34 connect to stationary contacts 38. Circuit breaker terminals 36 connect to stationary contact 40 through electrical conductor 42 and bimetal 44.

Stationary contacts 38 and 40 of each pole are disposed in a spaced-apart relationship. A bridging contact 46 is provided which, with the circuit breaker in the closed position, completes an electrical connection between stationary contacts 38 and 40. Thus, with the circuit interrupter 20 closed, an electric circuit is completed from a terminal 34 through stationary contact 38, through bridging contact 46, through stationary contact 40, through electrical conductor 42, through bimetal 44, to circuit breaker terminal 36. The bridging contact assembly 45 includes the movable bridging contact 46 attached to one portion thereof which, when the circuit interrupter is closed, completes an electrical connection between stationary contacts 38 and 40.

In this transformer the bridging contact is located below the bimetal 44. This is necessary in the event that should the transformer develop an oil leak, the bimetal will be first to be exposed above the oil in the gas space and will heat up rapidly, causing the breaker to trip while the parts 46, 38, 40 are still under the oil. This sequence of operation is desirable since it prevents contact arcing in the volatile gas space above the reduced oil level.

Each pole of the circuit breaker 20 is provided with an elongated contact arm 48 which at one end is rigidly secured to a through shaft 50. Shaft 50, which can be a metallic member, connects together the elongated contact arms 48 of all poles of the circuit interrupter 20 for simultaneous movement. The bridging assembly 45 is connected to the end of the elongated contact arm 48 opposite shaft 50. An insulating member 52 is provided at the end of contact arm 48 so that the arm 48 is electrically insulated from the contact bridging assembly 45. A spring 54 is provided in contact assembly 45 to provide uniform contact pressure and proper seating of the bridging contact 46 on the stationary contacts 38, 40. When any one of the poles of the circuit interrupter 20 open, all the other poles must also open.

Figure 4:
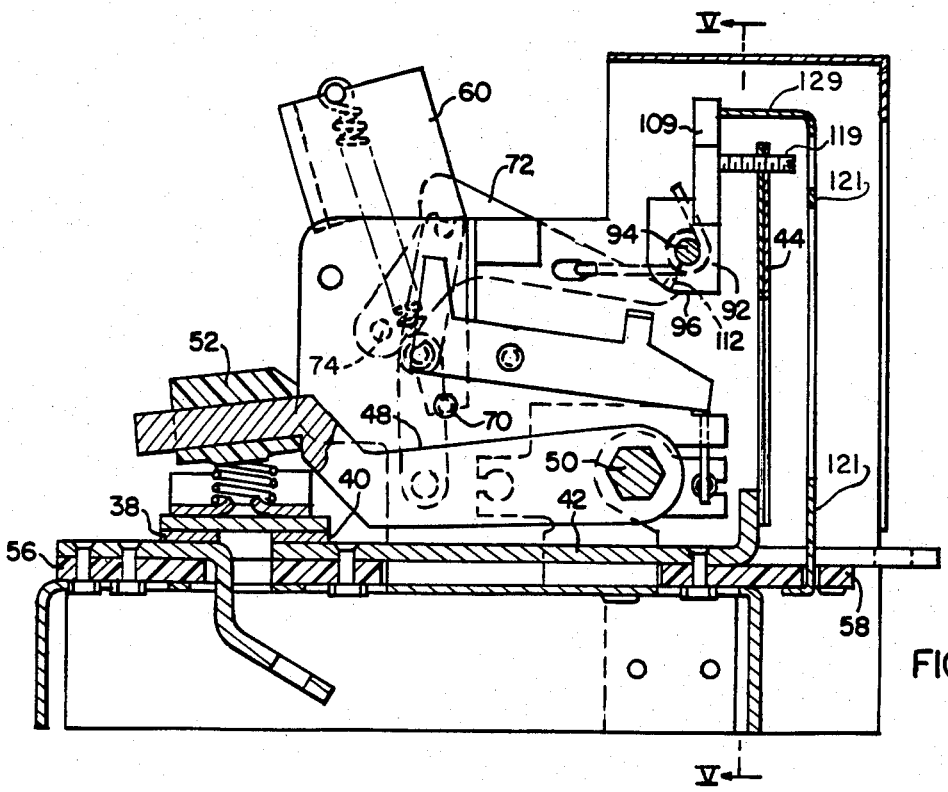
FIG. 4 is a vertical sectional view taken on the line IV—IV of FIG. 3.

The shaft 50 is rotatably supported by brackets 55 which are attached to the base 30. Stationary contacts 38, 40 are electrically insulated from base 30 by insulating sheet 56. Terminal 36 is connected to insulating sheet 58 which is rigidly secured to base 30. Electrical conductor 42 is insulated from base 30 by insulating sheets 56, 58 and dielectric 19 which fills the open spaces in the circuit breaker 20 during normal operation. Conductor 42 is generally L-shaped with its short leg portion attached to one leg of bimetal 44 (FIG. 4). The other leg of bimetal 44 attaches to L-shaped terminal 36.

Figure 3:
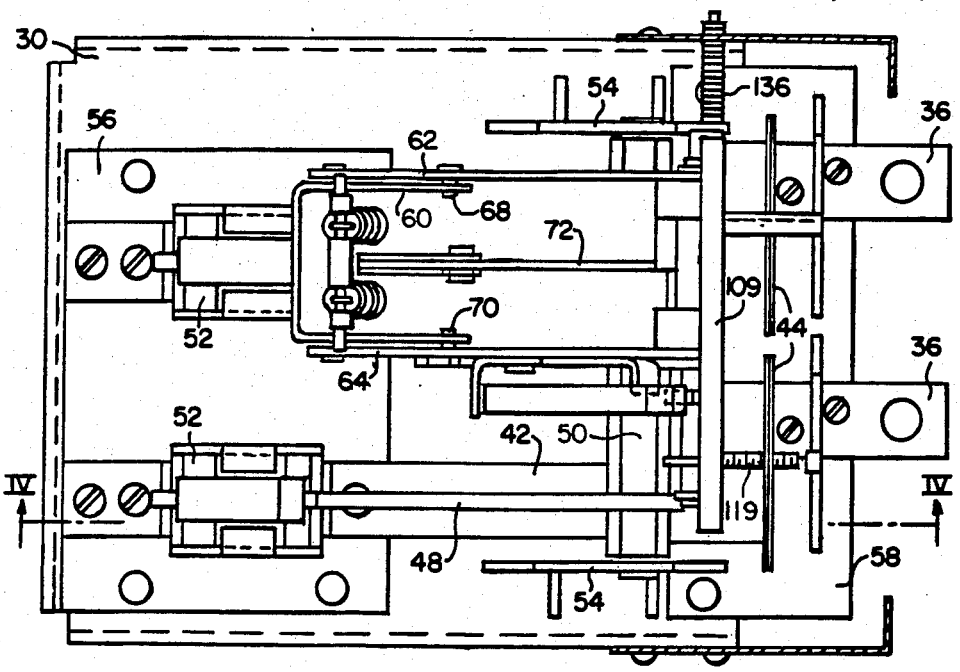
FIG. 3 is a plan view of the circuit breaker shown in FIG. 2 with the contacts in the closed position.

A single operator 60 actuates all poles of the circuit breaker 20. The operator 60 for all poles is mounted on side plates 62 and 64 which are securely attached to support base 30. The operator comprises a U-shaped member 66, the two legs of which are pivotally connected to side plates 62 and 64 at points 68 and 70 respectively (FIG. 3). A primary latch or releasable arm 72 (FIGS. 3 and 4) is pivotally connected to a shaft 74 disposed between side plates 62 and 64.

Pairs of toggle links 76 and 78 (FIG. 7) extend between the contact arm 48 and the releasable arm 72. A pair of toggle springs 80 are connected between a knee pivot pin 82 and the top of U-shaped member 66 for raising contact arm 48 with a snap action when releasable arm 72 is released. Toggle links 76, 78 are pivotally connected together by the knee pivot pin 82. The lower links 76 are connected at the lower ends by pivot pin 84 to the contact arm 48. The upper ends of the toggle links 78 have a U-shaped slot 87 (FIG. 8) formed therein which fits around a pin 86 connected to the arm 72. That is, primary latch 72 is disposed between the pair of upper links 78 with the pin 86 fitting in the slot 87.

The springs 80 extend between the knee pivot pin 82 and a pin 90 at top of U-shaped member 66. The upward force exerted by springs 80 holds toggle links 78 in engagement with shaft 86 on the arm 72. When the circuit breaker is assembled, the ends of the pair of links 78 are crimped to assure they remain in engagement with pin 86.

In accordance with this invention a latch lever 92 is mounted on a shaft 94 which extends between the side plates 62, 64. The lever 92 (FIG. 9) includes a cam surface 96 by which the end of the arm 72 is retained in the latched position during normal current flow. The latch lever 92 is rotatable on the shaft 94 between latched and unlatched positions and is retained in the latched position by a torsion spring 98. A pair of spaced upright members 101, 103 extend upwardly to form an opening 105. The members 101 and 103 are secured by similar bolts 107 to a trip bar 109 by which the latch lever 92 is rotated counterclockwise between the positions of FIGS. 10 and 11 in response to current overload conditions as set forth below.

The lever 92 includes at least two inclined surfaces 111, 113 at the lower end of the opening 105 between the members 101, 103. The inclined surface 111 forms a cam release edge 115 with the cam surface 96 and the inclined surface 113 forms a release edge 117 with the cam surface. A shoulder 112 separates the surface 111 and 113. The surfaces 111, 113 are at different angles, such as about 5° difference, so that upon rotation of the latch 92 counterclockwise, the release arm 72 may be released upon a greater or lesser overload current, depending upon which release edge 115, 117 is aligned with the arm 72. The latch lever 92 is slidable on the shaft 94 as is set forth hereinbelow.

When the latch 72 is so-positioned that the inclined surface 113 is aligned with the release arm 72, the release edge 117 causes the upwardly biased arm 72 to move off the cam surface 96 in the unlatched position in response to a smaller degree of counterclockwise rotation of the lever 92. On the other hand, when the release arm 72 is aligned with the inclined surface 111, the release edge 115 operates to retain the arm in a latched position until the lever 92 is rotated to a greater degree. The latch lever 92 which is biased toward latched position by torsion spring 98. When latch lever 92 moves to the unlatched position, arm 72 is released and rotates around shaft 74, collapsing the toggle links 76–78 and raising the contact arm 48.

As can be seen in FIG. 4 with the circuit breaker normally closed, the arm 72 rests against the cam surface 96. When the trip bar 109 is rotated a predetermined angle counterclockwise, the arm 72 moves off the release edge 115 to rotate to the unlatched position (FIG. 8) and trips open the circuit breaker 20. Trip bar 109 is rotated by current responsive means when the current through the circuit breaker 20 exceeds a predetermined value.

Each pole of the circuit breaker 20 includes an individual trip device including a current responsive bimetal 44, through which the load current of associated pole passes. The bimetal 44 is electrically connected in the circuit of the circuit breaker 20 in series relation with the breaker contacts 38, 40, 46. The bimetal 44 is generally U-shaped with an adjusting screw 119 threadedly mounted in the bight portion. One leg of the bimetal 44 is connected to fixed conductor 42 and the other leg of bimetal 44 is connected to fixed terminal 36. Adjusting screw 119 is disposed so as to contact the trip bar 109 when bimetal 44 deflects. Upon occurrence of, for example, an overload of less than 500% of normal rated current, the bimetal 44 is heated and deflects toward the latch lever 92. As the bimetal deflects due to the flow of current therethrough, the rounded edge of adjusted screw 119 engages the trip bar 109, rotating the lever 92 counterclockwise to a tripped position, releasing arm 92, and tripping open the circuit interrupter 20. The arm 72 then rotates around pivot 74, moving the line of action of the springs 80 to the left of toggle pivot knee 82, causing the toggle 76–78 to collapse and opens the circuit interrupter 20 with a snap action.

Figure 6:
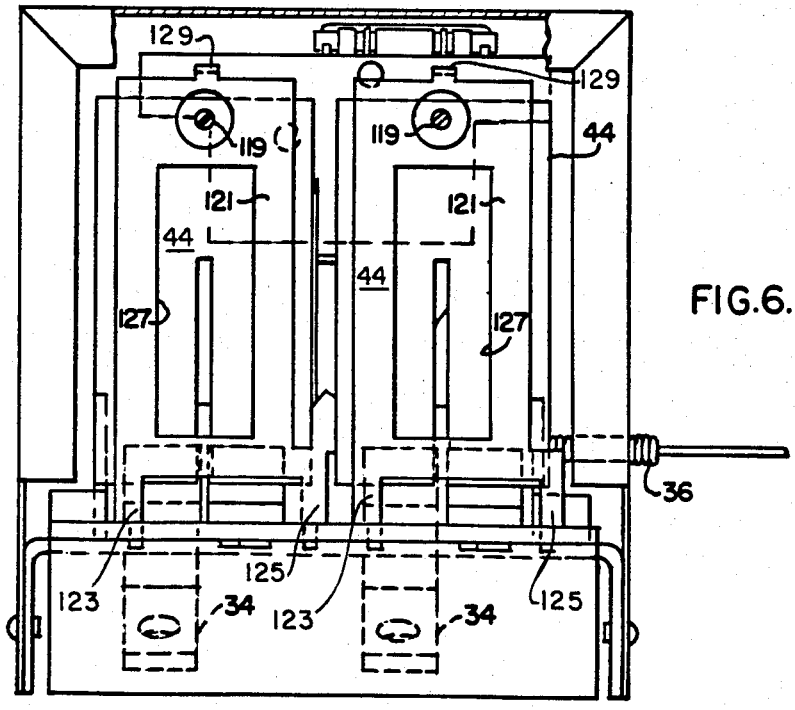
FIG. 6 is an end view of the circuit interrupter shown in FIG. 2, having portions removed for clarity, with the circuit breaker in the closed position.
Figure 7:
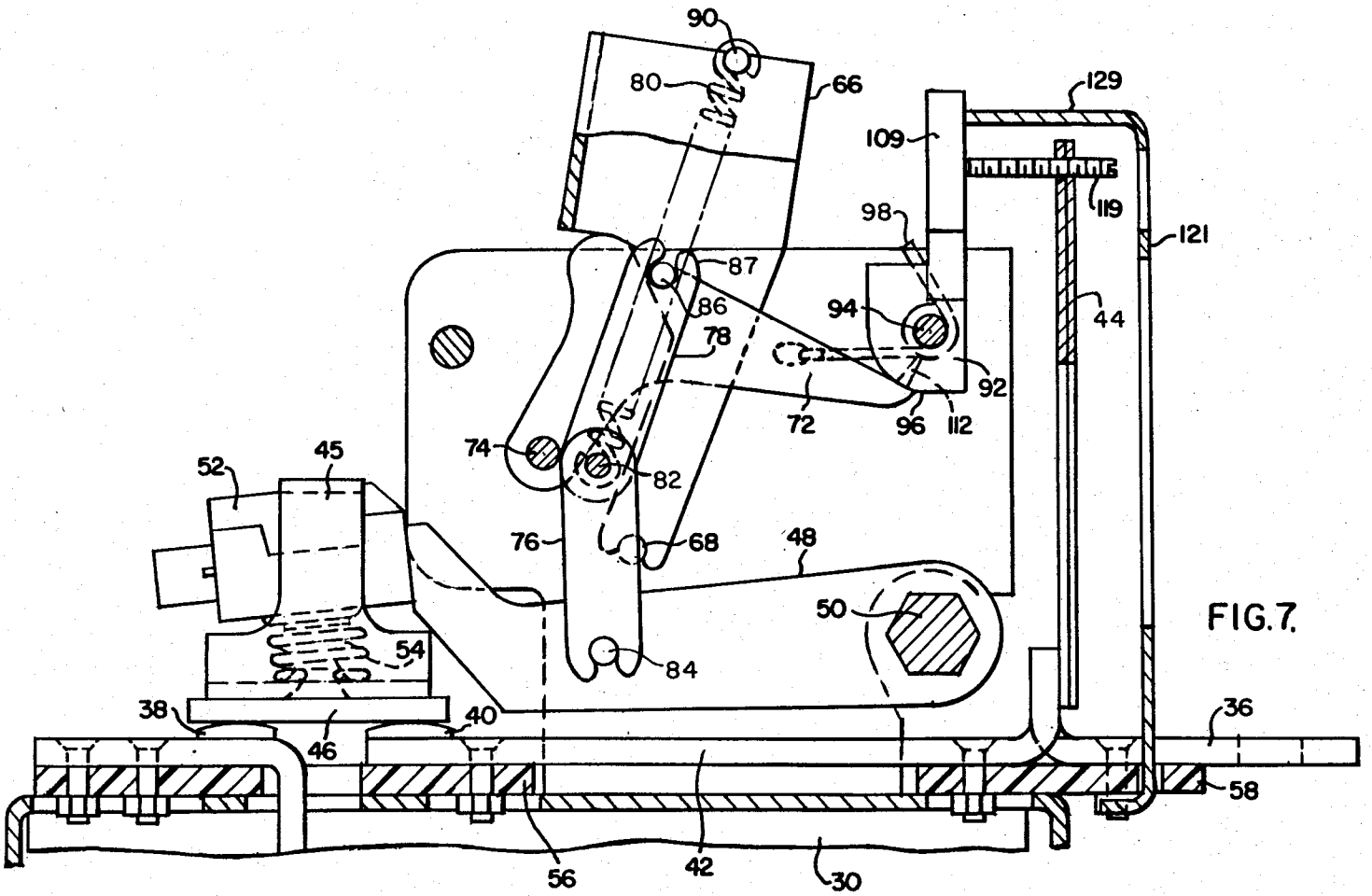
FIG. 7 is a vertical sectional view of the circuit interrupter shown in FIG. 2 having portions removed for clarity in the tripped open position.
Figure 8:
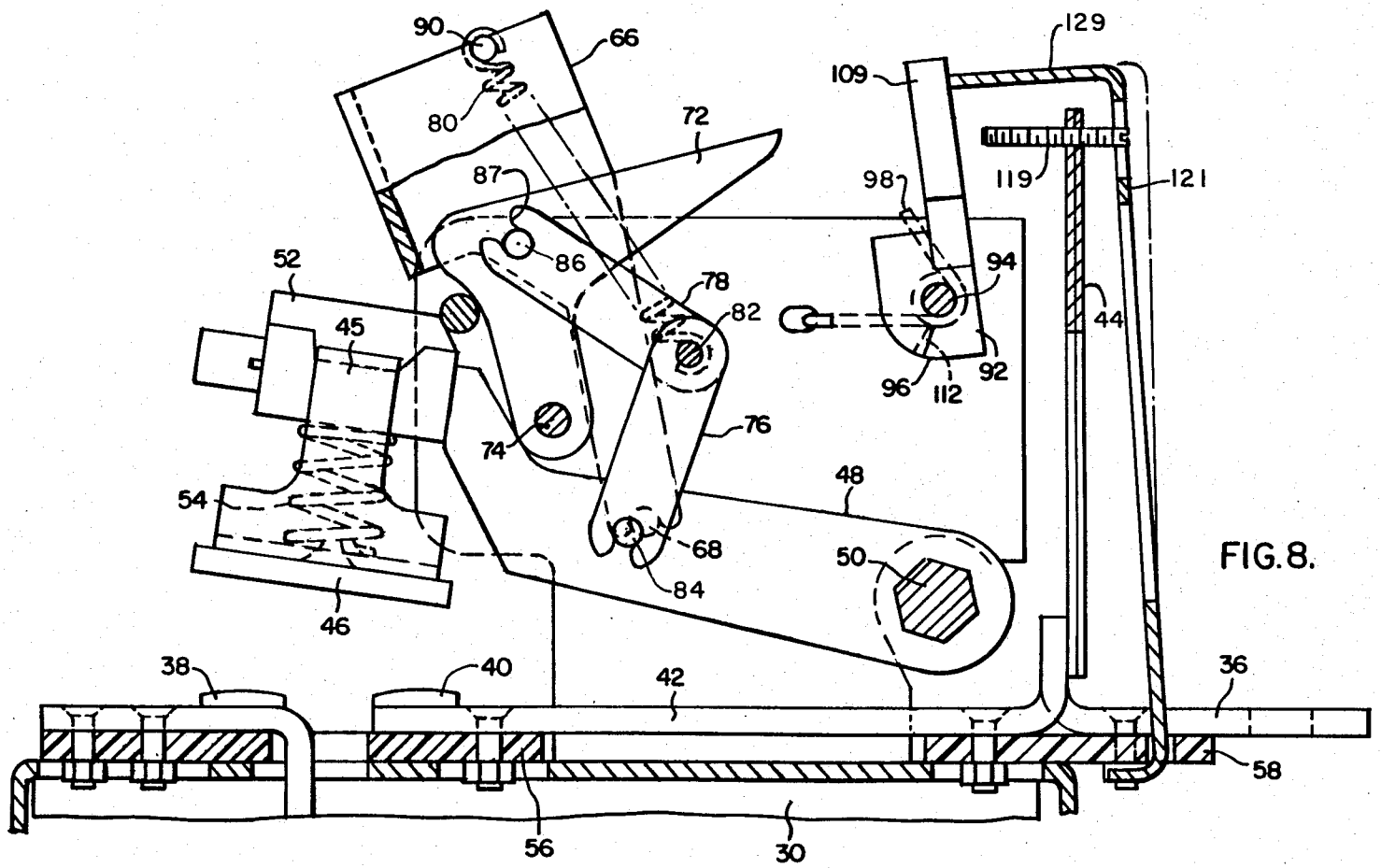
FIG. 8 is a vertical sectional view of the portion of the circuit interrupter shown in FIG. 2 in the normal open position.

Electromagnetic means are also provided to instantaneously trip the breaker. The electromagnetic trip means comprises a ferromagnetic member 121, disposed in proximity to bimetal 44. Ferromagnetic member 121, formed from a single piece of sheet steel, is supported by two leg portions 123 and 125 which are secured in a pivotal manner to insulating sheet 58 (FIG. 6). A main opening 127 is formed through member 121 to achieve proper attraction during the required operation. A short arm 129 extends from electromagnetic trip member 121 towards the bar 109. Upon occurrence of a high overload current, for example, greater than 500% of normal rated current flowing through the bimetal 44, the electromagnetic trip member 121 is drawn towards bimetal 44 in response to the overload current, whereupon arm 129 engages trip bar 109, rotating the lever 92 to trip open the circuit interrupter 20. Electromagnetic trip member 121 almost instantaneously trips open the circuit breaker 20 in the high overload conditions without moving bimetal 44. As can be seen in FIG. 7 as electromagnetic member 121 is drawn towards bimetal 44, trip arm 129 rotates trip bar 108 to release latch lever 92, causing the circuit breaker 20 to trip open. The breaker 20 opens, current flow through the bimetal ceases, and electromagnetic member 121 returns to its normal position. An opening 127 is also formed in electromagnetic trip member 121 to provide access to and clearance for adjusting screw 102 which is disposed in the bimetal 44.

Operating member 66, which rotates about pivots 68 and 70, provides a connection for one end of springs 80, and is mechanically linked to an operating handle 131 disposed on the transformer tank 1 (FIG. 11). Operating handle 131 is movable between an on position closing the circuit breaker 20 and an off position opening circuit breaker 20. The circuit breaker contacts 38, 40, 46 are manually opened by clockwise movement of operating member 66 (FIG. 7), as operating handle 131 is moved to the off position. Clockwise movement of the operator 66 carries the line of action of the overcenter springs 80 to the right of the longitudinal axis of link 78, whereupon the force of springs 80 causes a collapse of toggle 76–78, thereby moving the bridging contact 46 to the open position with a snap action. Contacts are closed by counterclockwise movement of the operator 66 (FIG. 4). This moves the line of action of the springs 80 to the left of the longitudinal axis of link 78 about pivot pin 82. Consequently, the springs 80 actuate the toggle 76–78 to its extended overcenter position, thereby moving the movable bridging contact 46 to the closed position with a snap action.

The circuit interrupter 20 is held in the closed position by the releasable arm 72 which is rotatable about pivot point 74. The cam surface 96 on latch lever 92 holds the arm 72 in the latched position. When lever 92 rotates in a clockwise direction about shaft 94, and arm 72 is released. When the arm 72 is released, the toggle 76–78 collapses with a snap action moving to the position shown in FIG. 7, opening circuit interrupter 20.

When the circuit interrupter 20 has tripped open, the arm 72 must be reset to a latched position before the circuit breaker can be closed. Relatching is effected by movement of the handle 66 beyond the off position in a clockwise direction to cause the arm 72 to move against one of the inclined surfaces 111, 113 to rotate the latch lever 92 counterclockwise against the bias spring 98. As soon as the end of the release arm 72 clears the release edge 117, the bias spring 98 returns the lever 92 to the latched position and the arm 72 is latched in place against the cam surface 96.

It is at times essential that operation of a transformer 10 be restored, at least temporarily, immediately after the circuit has been opened by operation of the transformer breaker 20 in response to an overload condition. However, there are occasions where it is difficult or impossible to reclose the breaker 20, especially if the oil 19 has been heated by a long continued overload current or a high ambient temperature, since the hot oil 19 maintains the bimetal element 44 deflected to its trip position and the operating assembly 60 cannot be reset. An emergency control is provided for emergency adjustment of the tripping mechanism to permit the circuit breaker to be closed and latched immediately following a tripping operation.

The emergency control permits the breaker 20 to temporarily carry a certain percentage of overload current for a predetermined time. The emergency control essentially permits changing of the circuit breaker 20 trip lever.

Figure 5:
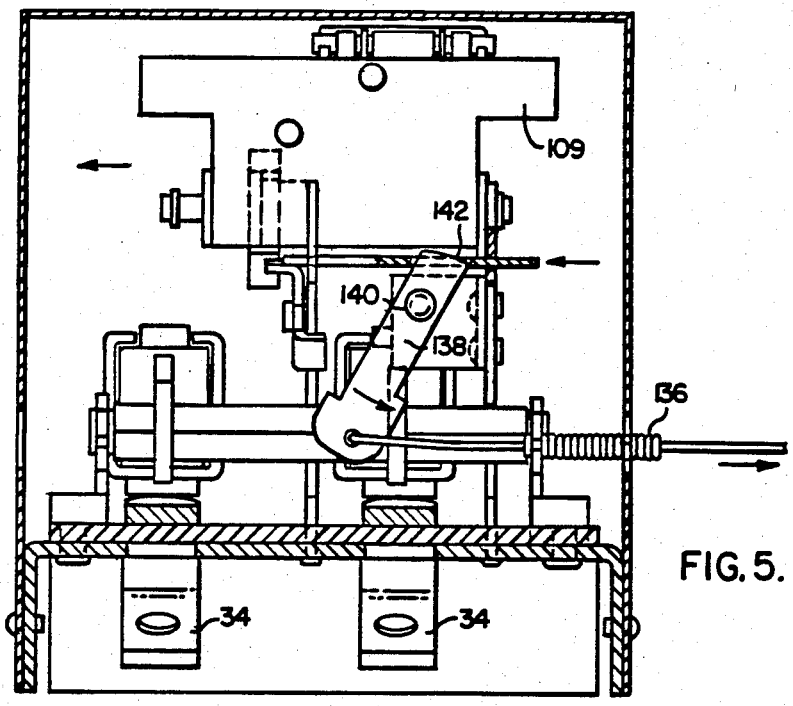
FIG. 5 is a vertical sectional view of the circuit interrupter taken on the line V—V of FIG. 4.

The latch lever 92 is slidably mounted on the shaft 94 so that the lever can be moved to the right or left to change alignment of the releasable arm 72 from one inclined surface 111, 113 to the other. As shown in FIG. 5, a push-pull cable 136 is connected to a lever 138 which is pivoted at point 140 which is connected with the lever 92 for moving it on the shaft 94. The other end of the push-pull cable 136 is connected to operating handle 142 (FIG. 1) which is mounted externally on the transformer tank 11. Thus, the rating of the circuit breaker can be increased by moving the external emergency control handle 142 from the normal position to the emergency overload position. More particularly, when the lever 92 is moved to the right, as viewed in FIG. 19, the releasable arm 72 is brought into alignment with the inclined surface 111, whereby a greater portion of the cam surface 96 retains the arm in place until the latch lever 92 is further rotated until the release edge 115 clears the end of the arm, such as when a dangerous overload condition exists.

Accordingly, the device for the present invention permits the elimination of a prior art secondary latch mechanism which in turn reduces the overall size of the circuit breaker as well as reducing the trip time necessary for opening the circuit.

What is claimed is:

1. A circuit interrupter comprising:

(a) relatively movable contact structure and contact arm for moving contacts between open and closed positions;

(b) operating means including an overcenter toggle and releasable arm operable to effect movement of the movable contact structure;

(c) lever means operatively connected to the overcenter toggle for moving the operating means between open and closed positions;

(d) the releasable arm being movable from a latched position to effect opening of the contacts;

(e) a latch lever movable between latched and unlatched positions of the releasable arm and being biased in the latched position of the releasable arm;

(f) trip means operable upon overload current conditions to initiate release of the latch lever;

(g) the latch lever being the only part operatively connected between the trip means and the releasable arm, and including a cam surface for latching and unlatching the releasable arm;

(h) the cam surface having at least two release edges for the arm; and (i) means for moving the latch lever laterally of the plane of movement of the arm so as to place a specific release edge in operating position with the arm, whereby the rating of the interrupter is changed.

2. The device of claim 1 in which the latch lever includes a shoulder between adjacent pairs of release edges.

3. The device of claim 2 in which the trip means includes bimetal actuating means having a bimetal through which the circuit interrupter current flows and which deflects an amount proportional to the current flow therethrough.

4. The device of claim 3 in which the trip means includes a ferromagnetic member proximate and responsive to the bimetal actuating means so as to actuate the trip means in response to predetermined overload conditions.

5. An oil-filled distribution transformer comprising:

(a) a housing;

(b) electrical inductive apparatus within the housing and having terminals thereon;

(c) a circuit interrupter disposed within the housing and operable between a closed position permitting current flow through the transformer and an open position interrupting flow through the transformer, the circuit interrupter being operable to automatically trip to the open position upon overload current conditions through the transformer;

(d) a handle connected to the circuit breaker for manually operating the circuit breaker between the open and closed positions;

(e) the circuit breaker including a releasable latch arm operable to maintain the circuit breaker in the closed position;

(f) trip means operable upon overload current conditions to initiate release of the latch arm;

(g) a latch lever movable between latched and unlatched positions of the releasable arm and biased in the latched position, the latch lever being the only part operatively connected between the trip means and the releasable arm;

(h) the latch lever having a cam surface for latching and unlatching the releasable arm;

(i) the cam surface includes at least two release edges for the arm, and (j) means for moving the latch lever laterally of the plane of movement of the arm so as to place one of the release edges in operating position with the arm whereby the rating of the interrupter is changed.

6. The device of claim 5 in which the latch lever is slidably mounted on a rotatable trip bar.

* * * * *